US005215625A

United States Patent [19]

Burton

[11] Patent Number: 5,215,625

[45] Date of Patent: Jun. 1, 1993

[54] METHOD FOR PRODUCING ARTICLES FROM WASTE FIBER, WASTE/SURPLUS PAINT, AND WASTE/SURPLUS INK

[76] Inventor: R. Edward Burton, 222 Franklin Ave., Willits, Calif. 95490

[21] Appl. No.: 844,546

[22] Filed: Mar. 2, 1992

[51] Int. Cl.[5] ..... D21F 1/66

[52] U.S. Cl. ..... 162/189; 162/DIG. 9; 264/37; 106/653

[58] Field of Search ..... 162/189, DIG. 9; 264/37; 106/653, 674, 486

[56] References Cited

U.S. PATENT DOCUMENTS

| | | | |
|---|---|---|---|
| 3,909,470 | 9/1975 | Lambuth et al. | 162/187 |
| 4,159,224 | 6/1979 | Cederquist et al. | 162/189 |
| 4,256,446 | 3/1981 | Hinojosa et al. | 264/119 |
| 4,304,877 | 12/1981 | Blount | 521/154 |
| 4,734,393 | 3/1988 | Lowe et al. | 162/DIG. 9 |
| 5,064,454 | 11/1991 | Pittman | 55/302 |

*Primary Examiner*—W. Gary Jones
*Assistant Examiner*—Dean Tan Nguyen
*Attorney, Agent, or Firm*—Harris Zimmerman

[57] ABSTRACT

A method and apparatus for making productive use of waste products such as spoiled, waste, or surplus paint and ink and waste slurry from pulp products manufacturing includes dewatering the waste slurry to obtain fiber from the slurry, drying the fiber in bulk, and combining the fiber with a mixture of paint and/or ink to create a moldable mixture. The mixture is formed into a utilitarian shape and cured or dried to form a solid object. In another aspect, there is provided a portable, self-contained apparatus for receiving waste and surplus paint and/or waste and surplus ink and fiber waste, and producing molded products using the method described above. The portable apparatus may be located temporarily at a site where such wastes are generated to avoid the transportation of wastes that is made expensive by mandated transportation safety regulations. A further aspect of the invention comprises useful article fabricated from waste materials using the method described above. Such articles may include stepping stones used for pedestrian paths or gardens, acoustic panelling, flower pots and planters, sculptures, shipping containers and packing materials, and the like.

9 Claims, 3 Drawing Sheets

METHOD FOR PRODUCING ARTICLES FROM WASTE FIBER, WASTE/SURPLUS PAINT, AND WASTE/SURPLUS INK

BACKGROUND OF THE INVENTION

Despite over twenty years of increasing awareness and massive research and development regarding waste products, toxic byproducts, waste treatment and waste recycling, the problem of waste disposal continues to grow. Almost all waste disposal sites are landfill operations that have a finite capacity, and many sites are approaching their limits. The determination of new landfill sites has been made more difficult in recent years by the imposition of environmental reviews, environmental impact statements, local and regional legislation, and the legitimate concerns of neighboring residents. As a result, the number of landfill operations for waste and toxics disposal has diminished, and the cost of disposal has increased correspondingly.

Moreover, it has been found that many landfills have been releasing toxic substances and gases into the ground water and the ambient atmosphere. As a result, some landfills have been condemned and ordered to be closed, creating enormous cleanup projects that may or may not rectify the problem.

It is clear that the optimal method for dealing with waste products and toxic byproducts is to process these substances to form a useful material. Indeed, the only distinction between waste products and raw materials is that no useful purpose has been identified for the waste products. It is a truism that "pollution is a resource out of place." Many toxic byproducts are no more harmful than virgin raw materials used for various industrial purposes, yet the need to dispose of the "toxic byproducts" causes tremendous problems for manufacturers and industrial processors.

For example, paint used for interior and exterior surfaces is not considered a waste product or toxic substance, and is considered to be beneficial in protecting structures, enhancing esthetic appearances, and prolonging the life of wood and metal materials. However, paint that is off-color, aged, off-grade, surplus, or that has been frozen cannot be used for its intended purpose, and is classified as a hazardous waste. Likewise, ink intended for printing purposes that is old, surplus, or spoiled suddenly becomes a hazardous waste, even though the composition of waste paint or waste ink is the same as usable paint or ink. Thus it is apparent that the distinction between toxic substances and useful materials may be only a question of the use to which the substances are put, not any significant difference in the chemical composition.

Another material which poses a disposal hazard is waste slurry from pulp products manufacturing that produce paper plates, napkins, disposable diapers, paper towels, and the like. This slurry contains approximately 1-5% solids, the solids comprising pulp fiber that is too long or too short for the intended product. Waste fiber may be sent to a landfill as non-hazardous waste if it is converted into a cake that comprises at least 50% solids. The slurry is hazardous to aquatic life if discharged directly into the environment.

It would be ideal if substances such as spoiled, surplus, or waste paint or ink, or pulp waste slurry could be used productively, thereby obviating a significant waste disposal problem and at the same time producing useful articles from cheap or free waste materials. However, the prior art does not reveal any method or apparatus for productive use of such materials. The fiber, paint and ink wastes contain varying amounts of plastic, metal, dirt, and other "foreign" substances that make them unsuitable for reuse in the more demanding products that are produced by the companies that generate such wastes.

SUMMARY OF THE PRESENT INVENTION

The present invention generally comprises a method and apparatus for making productive use of identified waste products such as spoiled, surplus, or waste paint and ink and waste slurry from pulp products manufacturing. One aspect of the invention comprises a method for dewatering waste slurry from pulp products manufacturing to obtain fiber from the slurry, drying the fiber in bulk, and combining the fiber with a mixture of paint and/or ink to form a moldable mixture. The mixture is formed by any appropriate technique known in the prior art and cured or dried to form a solid object having a utilitarian configuration. The materials used to make the utilitarian object are relatively inexpensive or free, and would otherwise pose a significant and costly disposal problem. However, ink or paint adhered to a fiber matrix is a use for which these substances are intended, and the invention presents a means for combining materials that would be considered hazardous wastes into objects that have characteristics no more hazardous than many common construction materials, such as chip board, recycled paper products, and the like.

In another aspect of the invention, there is provided a portable, self-contained apparatus for receiving waste paint and/or waste ink and fiber waste, and producing molded products using the method described above. The portable apparatus may be located temporarily at a site where such wastes are generated to avoid the transportation of wastes that is made expensive by mandated transportation safety regulations.

A further aspect of the invention comprises useful articles fabricated from waste materials using the method described above. Such articles may include stepping stones used for pedestrian paths or gardens, acoustic panelling, flower pots and planters, sculptures, shipping containers and packing materials, and the like.

DESCRIPTION OF THE PREFERRED EMBODIMENT

Figure 1:
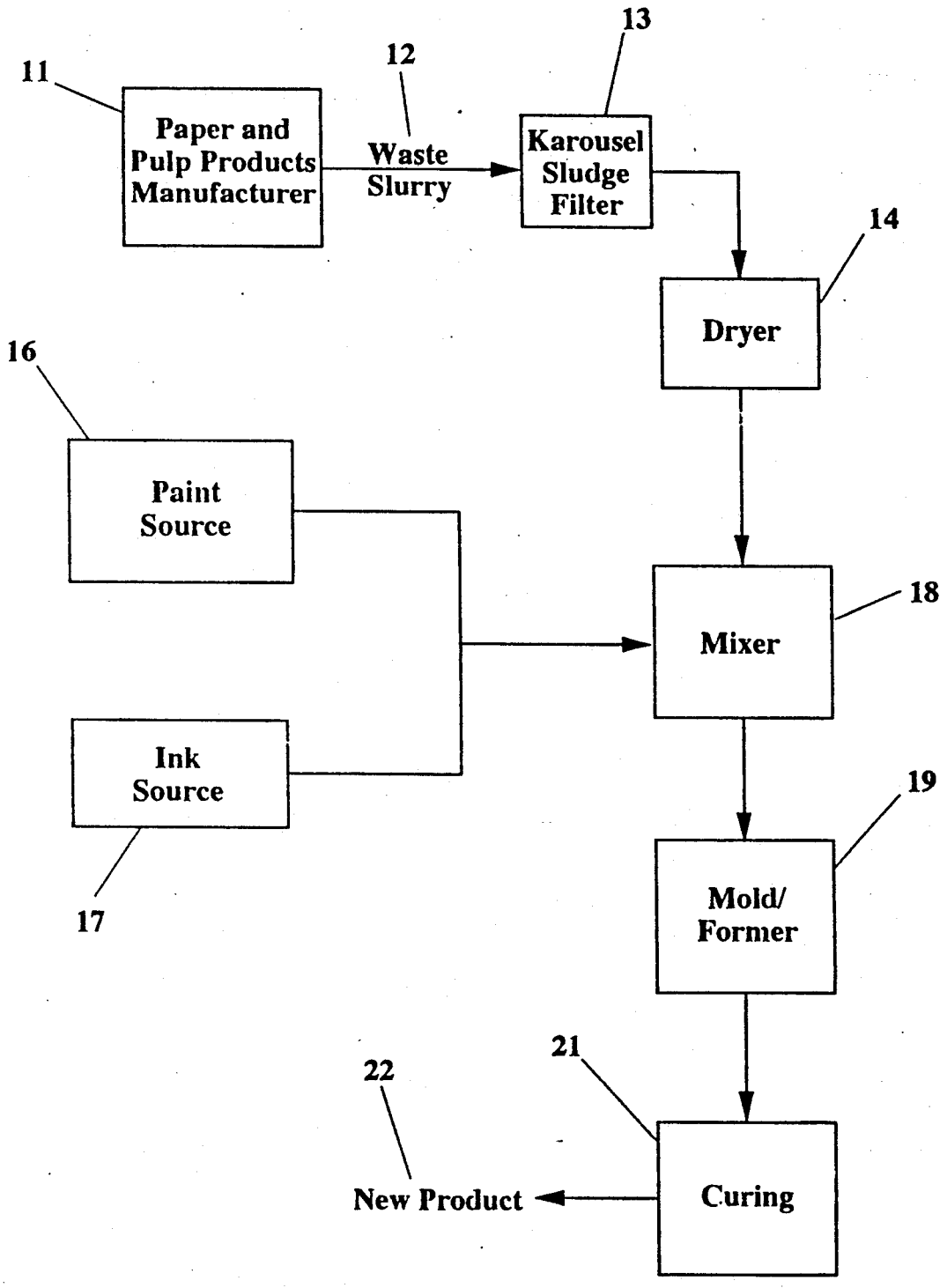
FIG. 1 is a functional block diagram depicting the steps in the method of the present invention.

The present invention generally comprises a method and apparatus for making productive use of identified waste products such as spoiled, surplus, or waste paint and ink and waste slurry from pulp products manufacturing. With regard to FIG. 1, the method of the invention includes deriving the requisite waste products from the respective manufacturing sources. For example, paper and pulp products manufacturing installations 11 produce a waste slurry 12 that typically contains approximately 1-5% solids. The solids are primarily pulp fiber that escapes the pulp fabricating process or comprise fibers that are too long or too short to be useful in the pulp/paper product. Rather than discharging this slurry into the surrounding environment, the present invention captures the slurry 12 and directs it to dewatering devices such as a Karousel Sludge Filter TM 13, known in the prior art. The sludge filter produces a "cake" containing up to 60% solids (40% moisture). The dewatered cake is then passed to a drying device 14, such as a low temperature oven, air dryer, or the like, which dries the cake to 85% solids (15% moisture). The fiber cake is suitable for use in the method of the invention when dried to approximately 15% moisture or less.

Another source of wood fiber for the invention is decorticated redwood bark fiber waste that is generated in the course of manufacturing redwood products.

The invention also includes the step of obtaining waste, surplus, or spoiled paint from industrial or commercial sources 16, and obtaining waste, surplus, or spoiled ink from manufacturers, printers, and like sources 17. Paint and ink may be labelled waste by being off-color, aged, frozen, off-grade, surplus, or contaminated with substances that affect the color or finish.

The paint and ink from sources 16 and 17 are combined and added to the dried pulp fiber in a mixer 18. Any mixer known in the prior art for industrial purposes, such as agitator, tumbler, or shaker mixing devices, may be employed. It may be appreciated that the dry pulp fiber has a substantial affinity for the solvents, pigments, and hardeners present in paint and ink compositions, due to the fact that paint and ink are generally formulated to adhere to materials (wood, wood products, paper and paper products) that contain a high percentage of pulp fiber. For this reason, the proportions of paint, ink, and fiber may vary considerably without affecting the quality of the final product. The proportions of the mixture include 1-3 parts by volume of waste fiber, 1-2 parts by volume of waste and surplus paint, and 1-2 parts by volume of waste and surplus ink. Indeed, ink may be eliminated entirely from the mixture, due to the fact that the hardeners present in paint formulations are sufficient to form a solid article in combination with the pulp fiber.

The mixture of fiber, paint, and ink, which has a dough-like consistency, is placed in a mold 19 or similar forming device. Techniques such as vacuum forming, centrifugal and turntable forming, pressure molding, and the like may be employed. The molded object is then cured and dried in a device 21. The curing step generally comprises heating the molded object in an oven to drive off the solvents and volatile components of the mixture, cause the hardeners of the paint to change from liquid to solid form, and to completely dry the object and form a new product 22. The heating step is conducted at a temperature ranging from approximately 150° F. to 250° F. for up to 8 hours. The parameters are varied on an empirical basis due to the variable composition of the mixture forming the molded object.

As an example of the method of the invention, three liters of pulp fiber at 20% moisture, mixed with one liter of waste/surplus paint, formed into a utilitarian object, baked and dried in an oven at approximately 230° F., produces a hard product suitable for use as an acoustic or mosaic tile. A harder, more durable product, suitable for manufacture of stepping stones and the like, is made using 1.5 liters of paint and ink mixture combined with one liter of fiber, and processed as described. To produce esthetically attractive acoustical panelling and wall board, decorticated redwood bark fiber waste is combined with a mixture of paint and ink and processed as described above to form the finished panelling.

Figure 3:
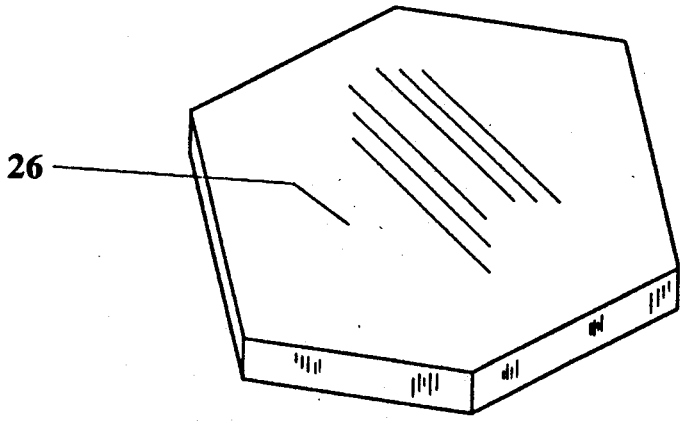
FIG. 3 is a perspective view of a stepping stone formed using the method of the present invention.
Figure 4:
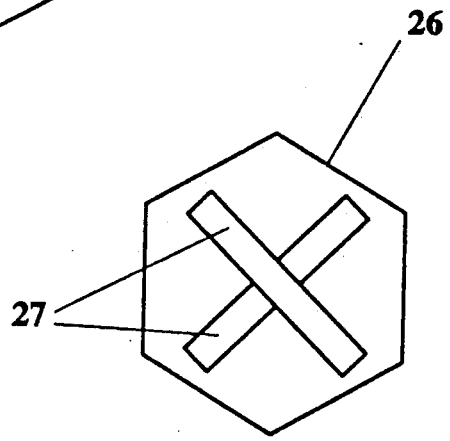
FIG. 4 is a plan view of the stepping stone depicted in FIG. 3.
Figure 5:
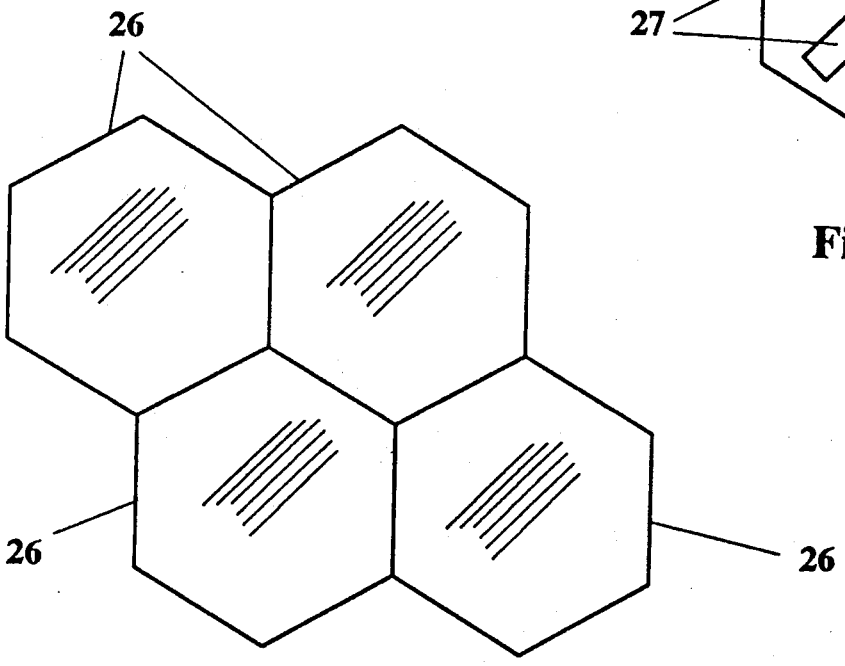
FIG. 5 is a plan view of a plurality of stepping stones formed according to the present invention and arrayed in a contiguous matrix.

With regard to FIGS. 3-5, one versatile and attractive shape for the molded product of the present invention is a regular hexagonal panel 26. The panels 26 may be used singly as stepping stones. Likewise, a plurality of panels 26 may be arrayed in contiguous fashion to form a continuous surface for acoustic insulation or esthetic purposes, or as stepping stones to form a pedestrian walkway. In any case, the paint and ink bind to the fiber in the object to form a utilitarian object that poses no toxic or environmental hazard.

As shown in FIG. 4, two reinforcing members 27 extending generally diametrically within the panel 26 and disposed mutually orthogonally are embedded in the middle of the panel to minimize warping as the molded product is cured and dried. The reinforcing members may comprise wood slats having a cross-sectional configuration of approximately one inch by three-eighths of an inch, although the exact dimensions are not critical, and may comprise scrap wood pieces that would otherwise be waste.

Figure 2:
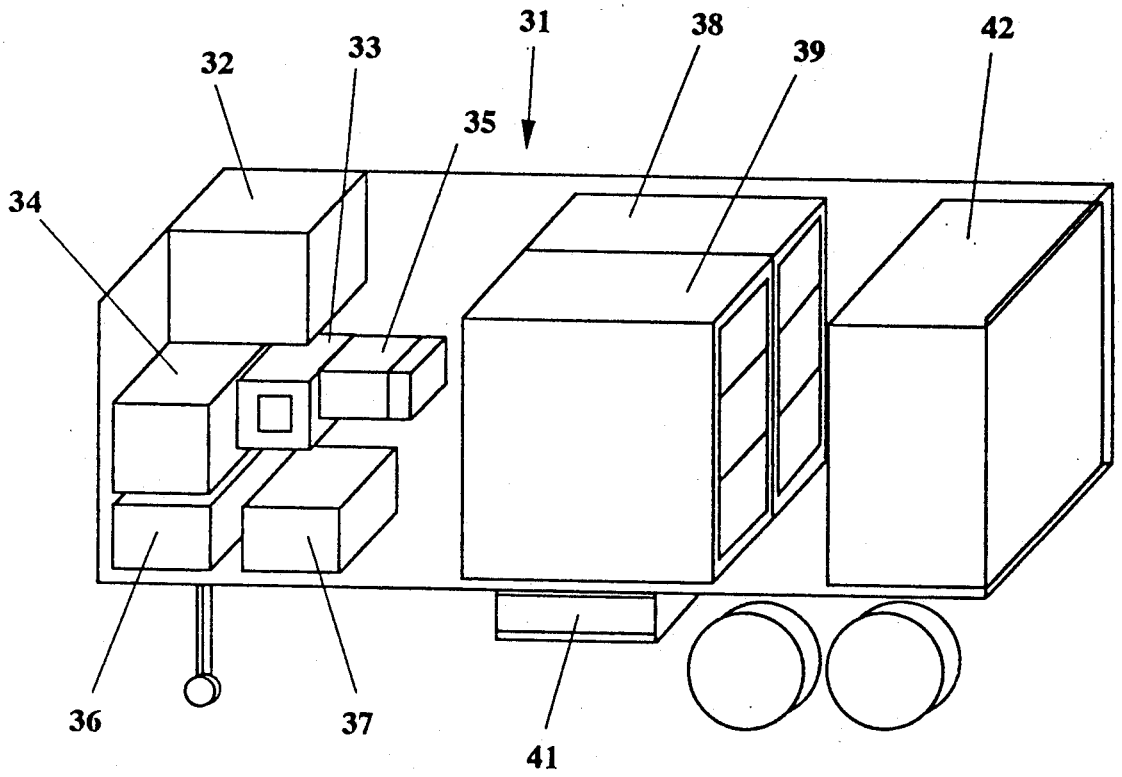
FIG. 2 is a schematic view of a portable, self-contained apparatus for producing utilitarian articles from waste materials using the method of the invention.

One embodiment of the apparatus of the present invention, shown in FIG. 2, comprises a portable, self-contained system 31 for producing molded products from waste/surplus paint and ink and fiber. The system 31 is housed completely in a highway trailer suitable for transport as a semi-tractor trailer rig to any site where disposal of these products is required. Within the trailer, a compartment 32 is designated for storage of waste/surplus paint and ink. Another compartment 37 is designated for storage of dry fiber at 50% solids, and compartment 36 is provided for storage of fiber at 90% solids (10% moisture). A paint can crusher 33 is provided to reduce the volume of waste created in the paint processing step. Compartment 34 is provided for the storage of molds and trays used to form the fiber-paint-ink mixture. A combined mixer and layup table 35 is disposed adjacent to the other compartments to facilitate mixing and forming of the fiber-paint-ink mixture into utilitarian objects.

In the medial portion of the highway trailer, ovens 38 and 39 are disposed to carry out the heating steps required in the method of the invention. Oven 38 comprises a low temperature oven (approximately 100° F.) for the purpose of pre-drying molded products for approximately 24 hours. Oven 39 is a high temperature unit (approximately 150° F.-250° F.) for drying fiber cake and for finish curing and drying molded products for approximately 8 hours. Beneath the ovens 38 and 39 and disposed on the exterior of the trailer is an air filter 41, such as a Bio-Nox TM filter known in the prior art, for treating the gases evolved in the ovens 38 and 39. At the rear of the trailer, an electrical generator 42 (diesel or equivalent) is disposed to provide power to the ovens, filter, can crusher, and lighting, instrumentation, and the like. The exhaust from the generator is also treated by the air filter 41.

It may be appreciated that all of the devices necessary to carry out the method described with reference to FIG. 1 are housed within the trailer of the mobile system 31. The mobility of the system 31 is advantageous in that paint and ink labelled as waste or surplus must be classified, handled and transported as hazardous waste, and treatment of such materials at the site of generation avoids the expense and difficulty of hazardous waste transportation procedures. After the present invention is used to process the waste and surplus paint and ink into utilitarian articles, the resulting products are not classified as hazardous or toxic; indeed, the products have commercial value and profit potential.

I claim:

1. A process for producing utilitarian articles from waste and surplus paint, waste and surplus ink, and waste fiber, comprising the steps of:

drying the waste fiber to at least 85% solids and less than 15% moisture:

mixing sufficient waste and surplus paint and waste and surplus ink with the waste fiber to form a moldable, dough-like consistency;

forming the mixture of waste and surplus paint, waste and surplus ink, and waste fiber into the shape of a utilitarian article;

curing and drying the formed article at an elevated temperature.

2. The process of claim 1, further including an initial step of obtaining waste slurry from pulp products manufacturing, said waste slurry containing solids including pulp fiber, dewatering said slurry to derive dry waste fiber therefrom.

3. The process of claim 2, wherein said dewatering step includes passing said waste slurry through a filter to form a solid cake containing said waste fiber.

4. The process of claim 1, further including an initial step of obtaining waste fiber from decorticated redwood bark waste derived from redwood products manufacturing.

5. The process of claim 1 further including an initial step of obtaining waste fiber from the manufacture of wood pulp products.

6. The process of claim 1, wherein the step of curing and drying the formed article comprises heating the formed article to 150° F.–250° F. for a period of 1–8 hours.

7. The process of claim 1, wherein the proportions of the mixture include 1–3 parts by volume of waste fiber, 1–2 parts by volume of waste and surplus paint, and 1–2 parts by volume of waste and surplus ink.

8. The process of claim 1, wherein said forming step further includes the step of embedding rigid reinforcing members in said article as it is formed to prevent warping of the finished article.

9. A process for converting hazardous waste and surplus paint, hazardous waste and surplus ink, and hazardous waste fiber to utilitarian use, comprising the steps of:

drying the waste fiber to at least 85% solids and less than 15% moisture;

mixing the waste and surplus paint, waste and surplus ink, and waste fiber in the proportions of 1–3 parts by volume of waste fiber, 1–2 parts by volume of waste and surplus paint, and 1–2 parts by volume of waste and surplus ink to form a moldable, dough-like consistency;

forming the mixture of waste and surplus paint, waste and surplus ink, and waste fiber into the shape of a utilitarian article;

curing and drying the formed article at an elevated temperature.

* * * * *